US009617612B2

(12) United States Patent
Scheid

(10) Patent No.: US 9,617,612 B2
(45) Date of Patent: Apr. 11, 2017

(54) STRUCTURES AND METHODS OF MANUFACTURE OF MICROSTRUCTURES WITHIN A STRUCTURE TO SELECTIVELY ADJUST A RESPONSE OR RESPONSES OF RESULTING STRUCTURES OR PORTIONS OF STRUCTURES TO SHOCK INDUCED DEFORMATION OR FORCE LOADING

(71) Applicant: The United States of America as represented by the Secretary of the Navy, Washington, DC (US)

(72) Inventor: Eric Scheid, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 202 days.

(21) Appl. No.: 14/593,392

(22) Filed: Jan. 9, 2015

(65) Prior Publication Data

US 2015/0298194 A1 Oct. 22, 2015

Related U.S. Application Data

(60) Provisional application No. 61/925,583, filed on Jan. 9, 2014.

(51) Int. Cl.

| | |
|---|---|
| ***C21D 7/00*** | (2006.01) |
| ***F42B 1/032*** | (2006.01) |
| ***C21D 7/02*** | (2006.01) |
| *C22F 1/04* | (2006.01) |

(52) U.S. Cl.

CPC ..... *C21D 7/00* (2013.01); *C21D 7/02* (2013.01); *F42B 1/032* (2013.01); *C21D 2201/05* (2013.01); *C22F 1/04* (2013.01)

(58) Field of Classification Search

CPC ..... B21D 26/06; B21D 26/08; C21D 7/00; C21D 7/02; C21D 2201/05; C22F 1/00; C22F 1/04; F42B 1/02; F42B 1/032

See application file for complete search history.

(56) References Cited

U.S. PATENT DOCUMENTS

| | | | | |
|---|---|---|---|---|
| 3,112,700 A * | 12/1963 | Gehring, Jr. | ..... | C22C 11/00 102/301 |
| 4,598,643 A * | 7/1986 | Skrocki | ..... | F42B 1/032 102/307 |
| 5,279,228 A * | 1/1994 | Ayer | ..... | F42B 1/032 102/306 |

(Continued)

OTHER PUBLICATIONS

"Strain path change effect on dislocation microstructure", Materials Chemistry and Physics, Sakharova et al., Jan. 2006.*

(Continued)

*Primary Examiner* — Edward Tolan

(74) *Attorney, Agent, or Firm* — Christopher A. Monsey

(57) ABSTRACT

Structures and methods of manufacturing utilizing direction of force loading or shock induced deformation of structures including microstructures produced in accordance with embodiments of the invention are provided. In one example, a method of manufacturing and structure including providing a metallic plate; forming said plate such that an original longitudinal direction of rolling the plate is perpendicular to a long direction of the plate, thus a force load on the plate would then be distributed over the longitudinal direction.

5 Claims, 6 Drawing Sheets

(56) References Cited

U.S. PATENT DOCUMENTS

| | | | | |
|---|---|---|---|---|
| 5,615,465 | A * | 4/1997 | Broussoux | B21C 23/001 102/307 |
| 6,464,019 | B1 * | 10/2002 | Werner | E21B 43/117 102/307 |
| 2013/0078139 | A1 * | 3/2013 | Lowe | C22F 1/183 420/591 |

OTHER PUBLICATIONS

"A dislocation-based multi-rate single crystal plasticity model", International Journal of Plasticity, Hansen et al., Jan. 2013.*
"Dislocation-crystal plasticity simulation based on self-organization", Materials Science Forum, Yamaki et al., Jan. 2006.*

* cited by examiner

STRUCTURES AND METHODS OF MANUFACTURE OF MICROSTRUCTURES WITHIN A STRUCTURE TO SELECTIVELY ADJUST A RESPONSE OR RESPONSES OF RESULTING STRUCTURES OR PORTIONS OF STRUCTURES TO SHOCK INDUCED DEFORMATION OR FORCE LOADING

CROSS-REFERENCE TO RELATED APPLICATIONS

The present application claims priority to U.S. Provisional Patent Application Ser. No. 61/925,583, filed Jan. 9, 2014, entitled "DISTRIBUTED LONGITUDINAL LOADED PLATE APPARATUS AND METHOD OF MANUFACTURING," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 103,025) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

Generally, embodiments of the present invention relate to structures and methods of manufacturing utilizing direction of force loading or shock induced deformation of structures including microstructures produced in accordance with embodiments of the invention. Examples include a distributed longitudinal loaded plate apparatus and method of manufacturing. Embodiment of the invention can produce desired structural performance under such force loading such as strain loading. Embodiments of the invention also relate to distributing load of an impact over a greater surface area without having to change mass or materials associated with a design. Alternatively, an embodiment of the invention can be used to use variants of the invention to achieve improvements in size, mass or other physical characteristics.

Material properties of a structure or material can change with a material's grain: size/shape/orientation relative to a force load. The term grain can refer to crystallites which can include a description of different degrees of organization such as crystalline, polycrystalline, or amorphous structural organizations. Grain boundaries can be described as interfaces where crystals of different orientations meet. A grain boundary is a single-phase interface, with crystals on each side of the boundary being identical except in orientation. Grain boundary areas contain atoms that have been perturbed from their original lattice sites, dislocations, and impurities that have migrated to the lower energy grain boundary. Grain boundaries disrupt the motion of dislocations through a material. Dislocation propagation is impeded because of the stress field of the grain boundary defect region and the lack of slip planes and slip directions and overall alignment across the boundaries. Polycrystalline materials are solids that are composed of many crystallites of varying size and orientation. Grains are small or even microscopic crystals and form during the cooling of many materials. Their orientation can be random with no preferred direction, that can be described as having a random texture or direction, possibly due to growth and processing conditions. Areas where crystallite grains meet are known as grain boundaries. Most inorganic solids are polycrystalline including all common metals and many ceramics.

Research in this inventive effort discovered, among other things, that the nature of materials or structures under investigation can show behavior that can change under certain types of force loading or high strain rates (shocks, etc) on structures design according to embodiments of the invention. Materials that resist motion (failure) under lower strain rates can reverse normal behavior and promote motion under high strain due to behavior of dislocations in a material(s). A dislocation can be a crystallographic defect, or irregularity, within a crystal structure. A presence of dislocations can strongly influence many properties of materials. For example, dislocations can stop motion and make materials stronger/brittle. Dislocations are in the way of movement. However, high densities of organized dislocations can become slip paths for exemplary material subjected to an exemplary force such as shocked material. What was strong becomes ductile. Efforts were made to develop ways of utilizing direction of shock induced deformation including in design of shape charges as well as other structures.

A problem encountered with regard to development of some embodiments of the invention arose in association with analysis of munitions that found a variation in the depth of penetration of a shaped charge jet sufficiently critical to alter application of such munitions. A shaped charge 1 can be an explosive charge 3 designed to focus the energy of the explosion to perform more work than could otherwise be done with bulk explosives alone. A shaped charge 1 can be a cylindrical charge 3 with a detonator 5 at one end and a hollow cavity 7 at the other. The cavity 7 can serve to focus gaseous detonation products resulting in an intense localized energy or force referred herein as a "jet". The shaped charge cavity 7 can be lined with thin metal but other materials such as glass or ceramics can also be used (e.g, sometimes referred to as a liner). Shaped charges 1 can be constructed in many different designs, shapes and sizes. One configuration can be a charge 3 and a thin, conical copper liner 7 with an apex angle 9 less than 60°. A distance between the shaped charge 1 section with the cavity 7 oriented towards a target 8 can be referred to as a stand-off distance 10. Effectiveness of a shaped charge can be related to characteristics of the jet. The jet works by pushing target 8 material out of its way and forming, e.g., an entry hole in the target 8. Little of the target's 8 material is consumed or ejected from the entry hole. Instead, target material is compressed into the side of the hole. Operation of a shaped charge is a violent, explosive event. The explosive generated shock front interacts with the liner. Under extreme temperature and pressure the liner material takes on the properties of an inviscid, incompressible fluid but remains a solid material undergoing extreme deformation best described with visco-plastic relationships. The explosive energy associated with the charge in this study accelerates the liner material to velocities beyond 13 mm/μs (13,000 m/s) and at extreme pressures over 25 GPa. An exemplary strain rate ($\dot{\epsilon}$) exceeds $5\times10^6$ $s^{-1}$. During this process, the direction in which the slip planes in the material form change to comply with the overwhelming forces driving liner collapse. The collapse of the liner is described as a series of concentric cones flowing into a series of concentric cylinders. The length is defined by the ability of the material to stretch and remain coherent.

Strain with respect to the jet can be associated with a differential in the velocity of the tip and tail. The greater the difference in these velocities, the greater the rate of elongation will be and the greater the jet length at a given distance or time of flight. The maximum length of a shaped charge jet can be determined from the added total length of the individual particles after jet breakup. Jet length is of primary importance in determining shaped charge performance. In some contexts, assuming a constant density of target and jet, target penetration can be a direct function of jet length.

Shaped charge performance can be defined by penetration depth. Penetration depth increases with jet length, and jet length is maximized by materials that are able to undergo significant strain without failure. Because the jet stretches as it proceeds towards the target, there can be a relationship between performance (defined by Lj) and the time (t) of flight and the associated distance (D), or "standoff", between the charge and the target. For all shaped charges, there is a distance at which the jet can no longer remain coherent. This can be a point of optimal performance. A slug can be a more massive section of material traveling at a lower velocity following the jet. The slug is capable of widening the impact hole but is not generally associated with penetration depth. The ratio of jet to slug is a function of shaped charge design.

Some materials exhibit extreme ductility under the intense dynamic conditions involved in the shaped charge collapse process. Within a common material or alloy, factors such as material texture, grain size and shape are known to affect jet elongation. Finer grain size can be attributed to jet elongation.

Reduced grain size can improve jet elongation and charge performance. Grain size is associated throughout liner material characterization in various forms of the Hall-Petch relationship which includes yield stress. Yield stress ($\sigma y$) is related to a basic yield stress ($\sigma yo$) that can be regarded as the stress opposing the motion of dislocations, k (Petch slope) is a constant indicating the extent to which dislocations are piled up at barriers (grain boundaries, inclusions, etc) and d is a grain diameter. Other forms of Hall-Petch reflect flow stress, residual stress, lattice frictional stress, and hardness to a factor of, e.g., grain size-½. Hall-Petch relationships are valid below a recrystallization temperature of a material of interest.

Crystallographic texture describes the distribution of crystallographic orientations of the microstructure. A degree of texture describes the percentage of crystals having a preferred orientation. A value of relative concentration (R) with respect to a distribution expected in a sample with random grain orientation. Orientation distribution function (ODF) is another measure of texture defined as a volume fraction of grains oriented along a direction.

Shear bands are another described characteristic of shaped charge kinetics. These bands are characterized by massive collective dislocation activity in a narrow deformation zone with the adjacent matrix described by comparably low and homogeneous plastic flow. Shear band formation is promoted when homogeneous dislocation slip is inhibited or when an insufficient number of slip systems is available (weak and/or unfavorable texture). Shear banding is also associated with sudden drops in local flow stress and can be considered as a softening mechanism. They are also characterized as dislocation highways and dominant paths.

Relationships exist between microstructure and shaped charge performance. Liner deformation starts as the material interacts with the shock front. As a shock passes through material it generates dislocations, strain hardening and microstructural defects. Some primary deformation mechanisms associated with shock loading are dislocation generation and motion. The substructure generated depends on a number of shock wave and material parameters. The dislocation density ($\rho$) is directly related to pressure. A width of the shock wave is a function of grain size, pressure and time.

In one particular example, a short standoff associated with an application of such a munition suggested that jet formation and early velocity were of concern, not ultimate jet elongation. While manufacturing history suggested a metallurgical investigation, resolving the effect of undesirable variation in performance of a particular munition, e.g., shaped charge, required a systematic approach to investigate all potential causes. A variety of hypotheses were formulated and investigations resulted.

Eventually efforts included a metallurgical study and a focus of research turned to an investigation into if and how variables in cold working affect materials such as 1100 aluminum metallurgical properties and shaped charge performance. Shaped charge performance typically can be a function of jet length. Jet length is the stretch of elongated, coherent liner material flowing from a detonation of a shaped charge. Jet length is typically described as a distance of elongation at either the time of target impact or the moment of jet break up as it travels through open air. Shaped charge jet elongation is a function of the ability of the material to yield and demonstrate stable flow under very high strain rate. Jet elongation is associated with a differential between the velocity of the tip or front of the jet and that of the tail or rear of the jet. In this application, early formation and maximized elongation over short distances are important because standoff distance is short.

Research and conception efforts in one embodiment of the invention, shaped charges, lead to formation of a hypothesis that a given manufacturing process generates a characteristic microstructure in the material, and the response of a given liner to the explosive loading is a function of the inherent microstructure of the liner. This affects the deformation of the liner and initial jet formation under an explosive force load applied to the liner experienced during shaped charge collapse. Effects on deformation resulted in changes in an ability of a material to flow and efficiently form the shaped charge jet. Deformation under dynamic loading conditions is controlled by the microstructural features such as grain size, grain shape, orientation (both crystallographic and physical), size, shape, amount, location and distribution of inclusions. Inherent strengths and alignment of these microstructural features with respect to shock loading direction and shaped charge kinetics determine the flow of the liner material during liner deformation.

Aspects of this research effort focused on early jet formation thus it became necessary to observe representative shock-deformed material. Thus, a variety of new approaches to conducting such observations were necessarily created given a lack of existing capability to do so. Reliance upon existing capture experiments or equipment would not been capable of making needed observation thus would have only provided recovered material that witnessed the full deformation event thus masking or obliterating early deformation. This need for new experimental capabilities to conduct this inventive effort resulted in successful design, execution and validation of a unique experimental techniques allowing for a practical recovery of shocked shaped charge liners arrested in the first few microseconds of flow. The new experimental capability required only a small percentage of the explosive mass of the full charge, yet allowed experimentation with full-scale, as-fabricated (i.e. actual) liners. Recovery only involved about 100 gallons of water and a dip net. Material recovered from this experiment provided an opportunity for direct observations needed to conduct necessary research and discovery such as formation of the axial hole that often occurs in the center of a shaped charge jet; marked differences in the ability of material to flow associated with change in temper; formation of shear bands and strain during shaped charge collapse; development of texture during early shaped charge liner flow; anisotropy in the microstructure introducing the possibility of further refinements; and tensile fracture around the base of the liner. From examination of the effects of microstructure on early collapsed formation, new correlations between material properties and shaped charge collapse kinetic equations were derived. The process of developing these equations involved critiquing a set of hypotheses concerning the material science supporting shaped charge collapse. Ideally, these relationships will assist other research in this field and support further optimization of force loaded structures with similar desired structural properties such as charge design or with high-strain deformation applications in general.

This research gave rise to development of new designs such as an asymmetric scaled shaped charge design. The focus on early jet development initiated related discussions that evolved into a shape design capable of holding target hole diameter constant while varying penetration depth and charge explosive weight. Traditionally, all of these variables scale together. Benefits of these efforts and discoveries include providing an ability to create resulting designs projected to have approximately 60% of their original performance for 30% of an original explosive mass.

According to an illustrative embodiment of the present disclosure, a method of manufacturing and structure is provided including a process for exploiting relationships between a structure subjected to a force loading, e.g., a shaped charge liner, manufacturing processes, microstructures of the structure with respect to orientation of the force loading and design of the structure, and resulting desired behavior of the structure in response to the force loading, e.g., shaped charge jet formation.

For example, an exemplary embodiment can include providing a metallic plate; forming said plate such that an original longitudinal direction of rolling the plate is perpendicular to a long direction of the plate, thus an applied force loading on the plate in its end application structure would then be distributed over the longitudinal direction. Large and small grain microstructures can be manipulated or created with respect to manufacturing processes and direction of force loading with respect to the microstructure orientation (s) to create different structural or material properties. Embodiments of the invention provide a design process to create microstructural features of an end application structure based on the microstructural response to force loading such as high strain rates (e.g., during shaped charge jet formation after application of the shaped charge explosive force). Embodiments of the invention include a focus on a role of microstructure in controlling or influencing deformation mechanisms and material properties during application of force loading on a structure designed and produced according to an embodiment of the invention e.g., a shaped charge collapse and early jet formation.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, an effect associated with embodiments of the invention effect can be observed during an experiment designed to investigate strain characteristics of force loads on a structure e.g., explosively loaded thin aluminum, with known variations in microstructure. For example, upon loading with a controlled explosive shock, material with large grains oriented at shallow angles to the direction of an oncoming shock front (resulting in high angles with respect to the shock wave movement) can be observed to distribute the load away from the directly impacted surface area. Conversely, material with small grains oriented with essentially the opposite relative angles; (low angles with respect to the shock front) can be observed to deform dramatically and locally at an impacted area. In one example, shaped charges, factors which impact shaped charge formation can include one or more factors such as grain size, dynamic recrystallization (DRX), particle fracture, and shear bands and slip associated with a liner being subjected to force loading. Embodiments of the invention have potential application into a system that would benefit from an ability to better distribute impact loads.

Figure 1:
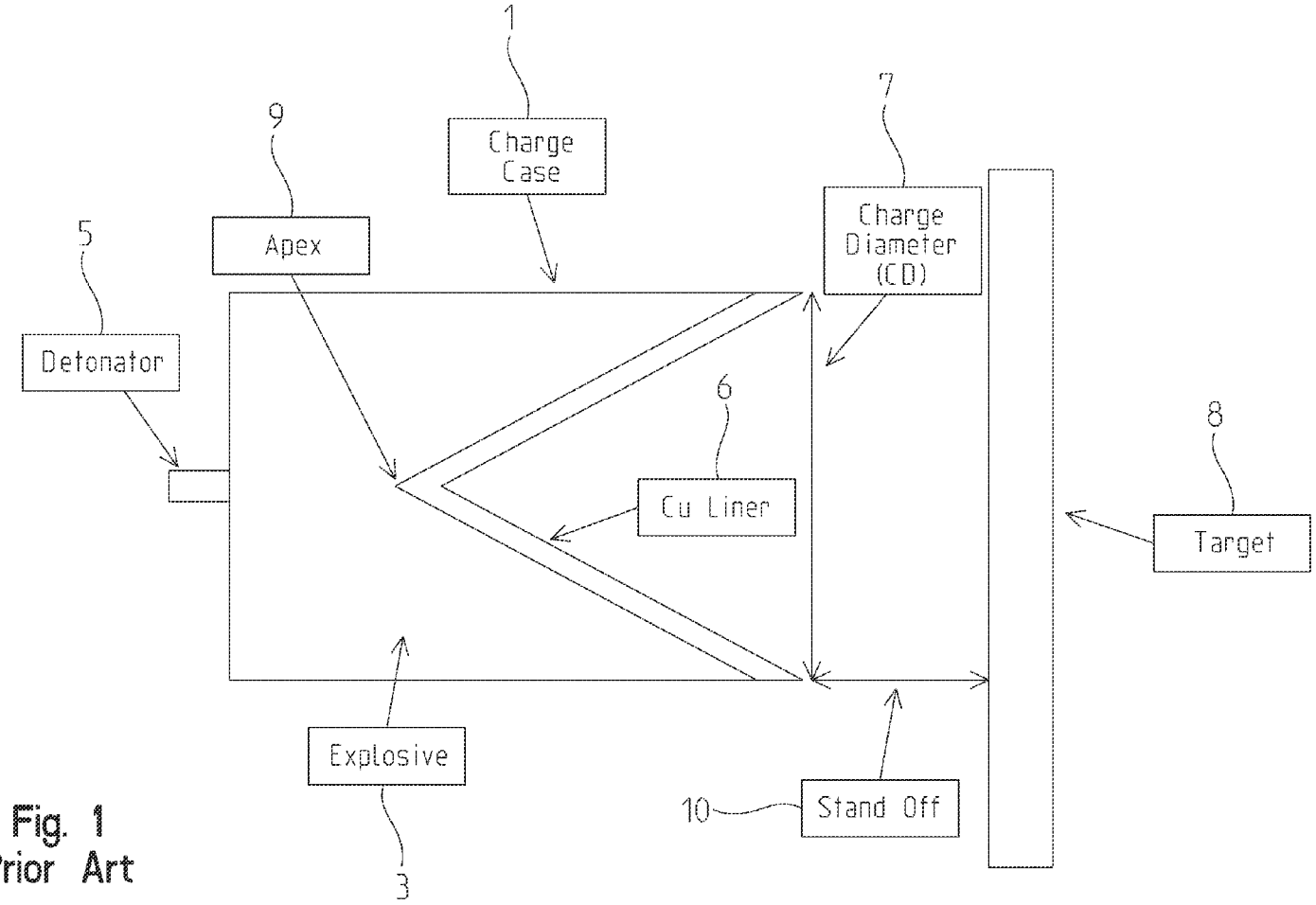
Fig. 1 Prior Art
FIG. 1 shows an exemplary shaped charge and target.
Figure 2:
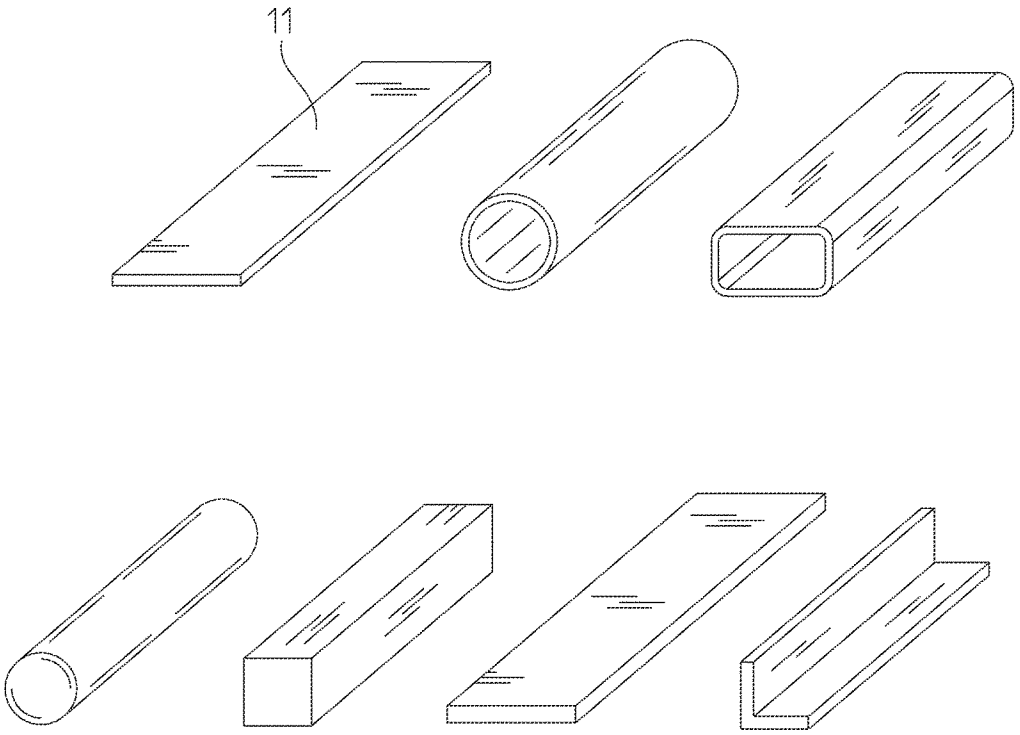
FIG. 2 shows an exemplary plates, tubes, rods, and thin shapes and descriptions of rolling direction and metal forming.

Referring initially to FIG. 2, a variety of sheet, plate, extruded tube, drawn tube, rolled and extruded rod and thin shapes are shown with direction of rolling as well as aspects of extruded or drawn items such as longitudinal or transverse sections. In one example, metal plates 11 can be constructed with a direction of rolling 3 parallel to a large surface area. An act of rolling the plate can produce this as shown in FIG. 2. An observation was made from an inadvertent construction of a shaped charge liner in such a way that, in conjunction with the complex shock wave development associated with this charge, put a load of a shock wave at a high angle with respect to the direction of rolling of a large grained material.

Figure 3:
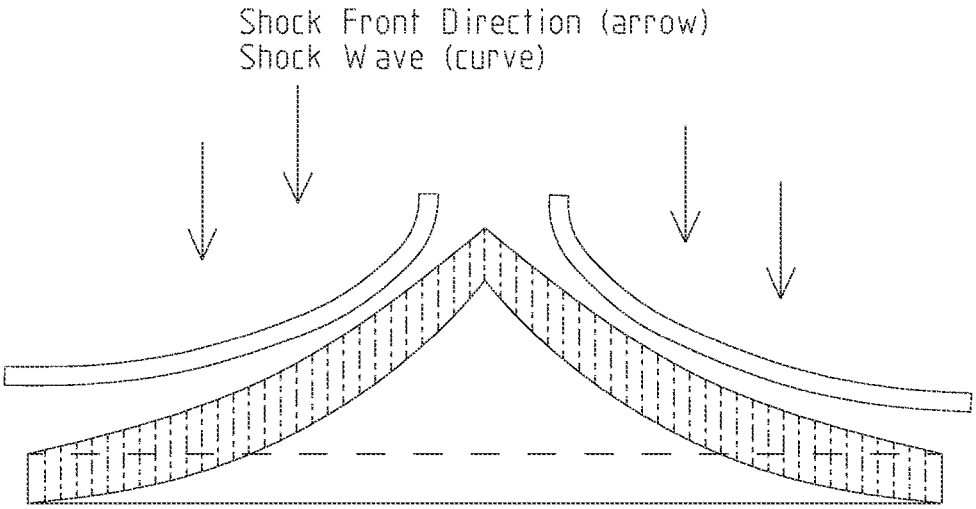
FIG. 3 shows an exemplary plate with a high angle loading with regarding to a shock.
Figure 4:
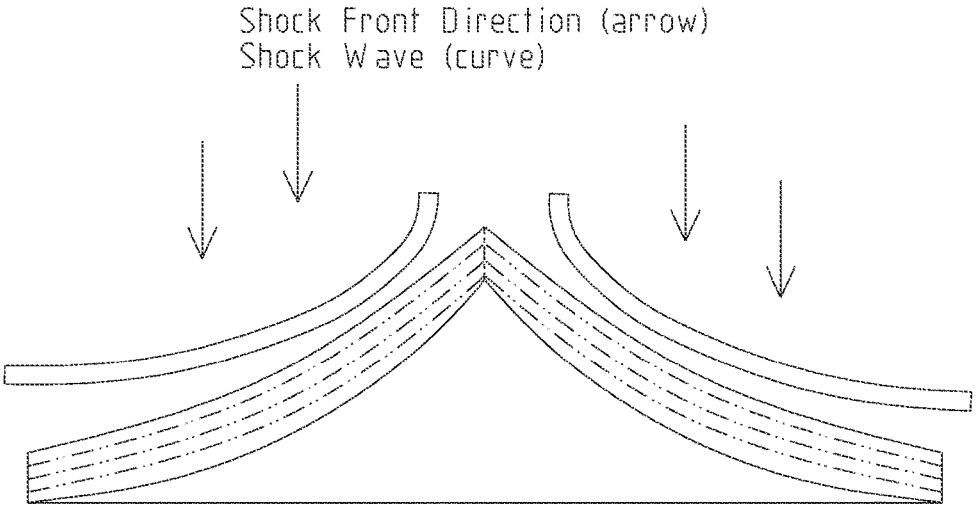
FIG. 4 shows an exemplary plate with a low angle loading with regard to a shock.

One such exemplary configuration is showing high angle loading with regard to shock wave is shown in FIG. 3. An exemplary low angle loading with regard to shock is shown in FIG. 4.

Figure 5:
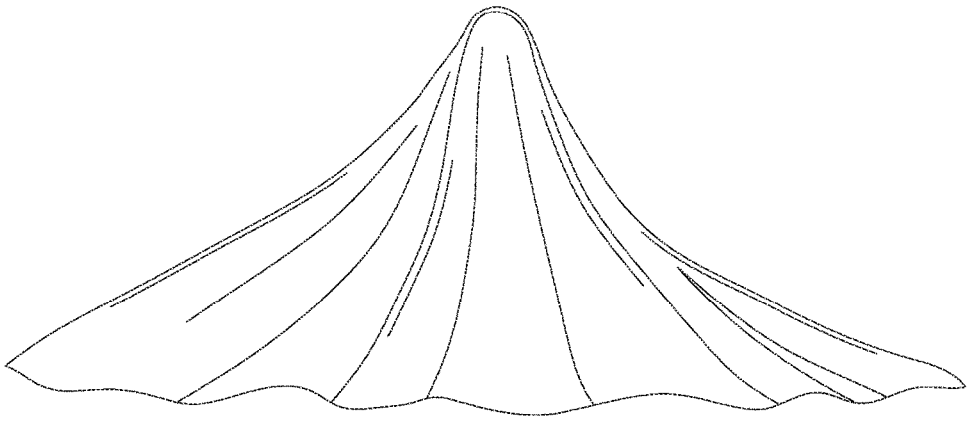
FIG. 5 shows an exemplary plate after a shock has been applied to it with a high angle of deformation.
Figure 6:
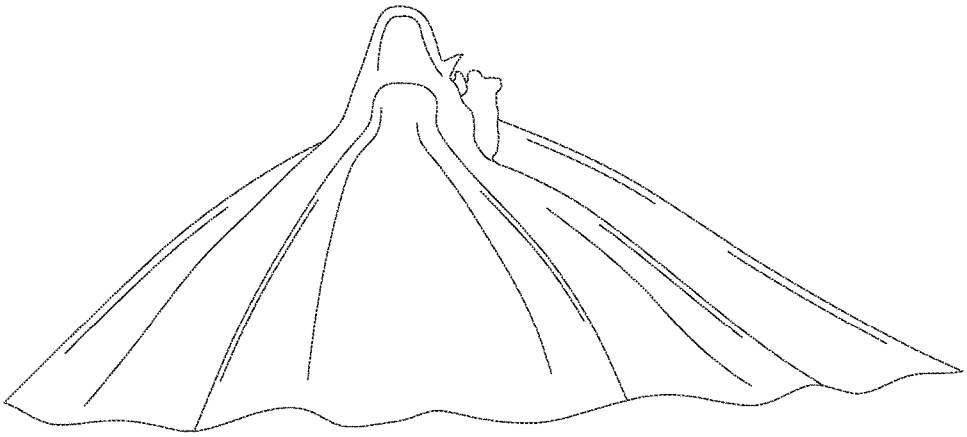
FIG. 6 shows an exemplary plate after a shock has been applied to it with a low angle of deformation.

Observed deformations associated with different angle deformations are shown in FIG. 5 and FIG. 6. As shown in FIG. 5, a high angle deformation associated with a large grain structure was deformed over a larger area but locally not as severely. FIG. 6 shows a low angle deformation structure that was deformed locally and torn.

Figure 7:
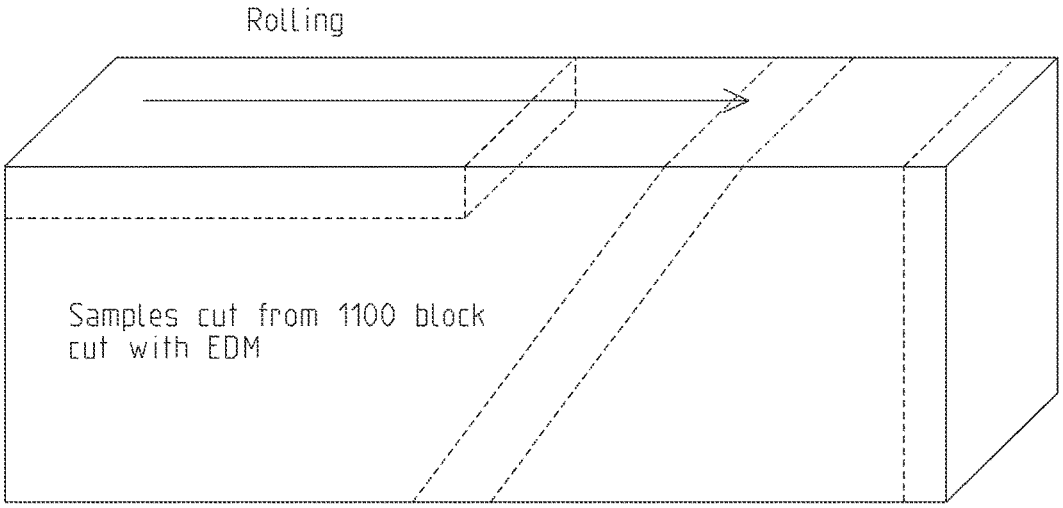
FIG. 7 shows exemplary samples cut from a 1100 A1 block to influence microstructures in a resulting exemplary plate.

Referring to FIG. 7, a cross sectional view of samples cut from 1100 A1 block to influence microstructure in resulting plates. One exemplary embodiment of the invention includes manufacturing a sheet or plate with its microstructure manipulated to orient the microstructure's grains in line with a direction of loading.

Figure 8:
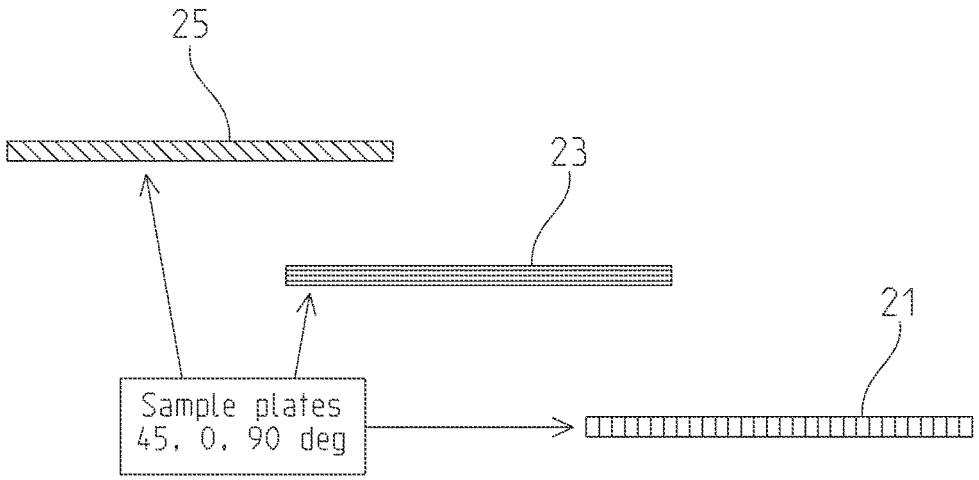
FIG. 8 shows resulting structures of exemplary plates.

A resulting sample from an exemplary method of manufacture is shown in in FIG. 8. A first plate 21 in FIG. 8 can represent a type of plate providing an ability to distribute a vertical load with one orientation of microstructures having a 90 degree orientation to a vertical load. A second plate 23 in FIG. 8 represents a typical plate with a direction of rolling in a long direction and associated with an angle of 0 degrees. A third plate 25 associated with an angle of 45 degrees is also shown.

Figure 9:
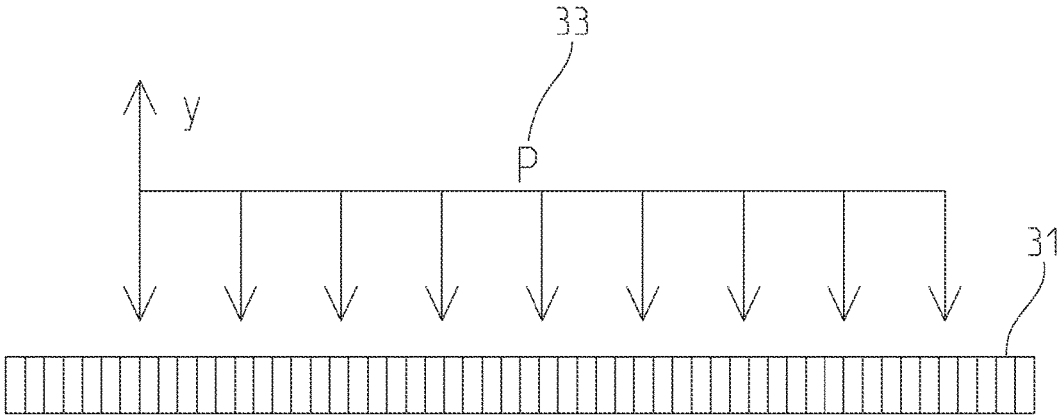
FIG. 9 shows a simplified diagram of a distributed longitudinally loaded exemplary plate.

FIG. 9 shows an exemplary distributed longitudinally loaded plate 31. FIG. 9 depicts one aspect of an embodiment of the invention. The exemplary plate 31 can be constructed in such that an original longitudinal direction of rolling is perpendicular to the long direction of the exemplary plate 31. Thus a load 33 on the exemplary plate 31 would then be distributed over the longitudinal direction. An exemplary embodiment of the invention has advantages such as an ability to distribute impact loads over a larger area without adding mass or size; a potential to reduce mass and size while better distributing load; and wide potential application.

A relative alignment or elongation of a material's microstructure with respect to a flow direction of, e.g., a shaped charge liner, can influence liner collapse kinetics. A presence and orientation of active slip planes in the form of shear bands introduced with manufacturing processes (e.g., cold work) alter the flow stress affecting flow velocity. Shear bands act as dislocation highways and dominant paths for plastic flow. A hypothesis that existing shear bands and corresponding slip planes in the microstructure, aligned at low angles to eventual jet elongation, can thereby enable more efficient flow. Without a pre-aligned structure, energy is lost generating dislocations and grain boundaries that would otherwise be imparted to flow.

During collapse, material that flows along slip planes associated with a direction of hydrodynamic flow that will ultimately occur. When active slip planes are preexisting (pre-aligned), flow is achieved at a higher velocity (sooner), as flow within bands occurs at lower stress (more stably) for a given strain. When active slip systems are not available or aligned with the direction of flow, the load associated with 10s of GPa of pressure results in localized slip in the form of narrow bands of recrystallized grains. These bands form from shear in the direction of motion and also at 45° to this motion as a response to elongation or compression. This appeared as DRX in recovered material. Smaller grains associated with the annealed liner required less energy to recrystallize but did not provide the favorably aligned slip systems.

In some embodiments, aspects can be summarized with the general proposed new relationship between velocity and material properties of equation 1.

$$V:=\left(\frac{h\rho bv}{2\varepsilon}\right) \qquad \text{Equation 1}$$

Equation 1 provides an expression between shaped charge liner kinetics and material properties on some embodiments of the invention. V stands for flow velocity, h represents shear band spacing, $\epsilon$ represents strain hardening property, p represents mobile dislocation density. Equation 1 can be applied assuming collapse facilitated by sliding along shear bands. The velocity is maximized in a strain-hardened material characterized by a high density of mobile dislocations organized in the direction of flow.

Research associated with this effort has recognized in relation to some embodiments of the invention an association between material prosperities, initial jet velocity and performance. Further, in some examples, this effort has established that a strain-hardened material with a high mobile dislocation density aligned to move in a direction of flow dictated by shaped charge kinetics will result in a higher jet velocity. In other words, liners constructed with heavy cold working in the direction of the liner contour will perform the most successfully. In some embodiments, this implies forging of the liner.

A method of manufacturing can include step 101 comprising determining strain hardened structure design parameters comprising a first force loading, a first force loading direction produced by said first force loading above a first predetermined force value, and a desired direction of material flow of said strain hardened structure produced upon application of said first force loading; at step 103, manufacturing said strain hardened end application structure with manufacturing-derived microstructure affecting shaped charge collapse and jet formation based on said strain hardened structure design parameters, wherein said strain-hardened structure (by forging) comprises a microstructure with grains elongated into narrow bands aligned with the desired direction of material flow.

In some embodiments, effects of shear banding can be induced in the microstructure by the act of forging. The bands enable flow with the liner contour by sliding of grain and sub-grain boundaries. The shear bands can provide highly localized dislocation highways allowing the matrix adjacent to the band to deform plastically at lower stresses. Flow into the collapse point is characterized by these primary shear bands. Once the flow jets along the axis of symmetry, secondary shear bands present in the matrix from strain-hardening elongation align nearly parallel with the direction of flow and thus promote more efficient flow.

Although the invention has been described in detail with reference to certain preferred embodiments, variations and modifications exist within the spirit and scope of the invention as described and defined in the following claims.

The invention claimed is:

1. A method of designing and manufacturing microstructures within a structure comprising:

defining a structure assembly comprising a plurality of sections including a first structure;

defining a first loading force with a predetermined orientation to a selected location or portion of the structure assembly comprising the first structure;

defining or determining a desired shock induced deformation structural result or force loading structural response in the first structure with respect to the structure assembly;

determining at least one plurality of first microstructures in said first structure at said selected location or portion of the first structure that produce said shock induced deformation structural result or said force loading structural response after application of said first loading force, said shock induced structural deformation structural result or force loading structural response comprising a direction of material flow within said first structure having said at least one plurality of first microstructures that is produced upon application of said first force loading; wherein said first microstructures are formed having a microstructure orientation that will either increase or decrease resistance to deformation at the selected location or portion caused by application of the first force loading at the predetermined orientation at the selected location or portion of the first structure, wherein said first microstructures comprises an elongated or stretched grain shape and microstructure orientation at the selected location or portion relative to the first force loading, wherein required microstructures at the selected location or portion comprises an elongation or stretching of the first structure's material grains in the selected location or portion of the first structure where the elongation or stretching of the material grain is produced to align with an alteration plane that is defined by a predetermined angle with respect to a vector of the first force loading at said selected location or portion of the structure; and manufacturing said first structure with manufacturing-derived microstructures comprising said first microstructures by pressing or rolling the first structure at said selected location or portion of the first structure to produce the elongation or stretching of the material grain at said predetermined angle, wherein said first structure thereby produced comprises said first microstructures having said grains elongated into narrow bands aligned with the direction of material flow produced in response to the first force loading and the first force loading direction.

2. The method of claim 1, wherein said manufacturing includes a forging step.

3. A method of manufacturing a structure with microstructures having a predetermined material flow in at least one section of the structure in response to subsequent shock or loading force comprising:

determining one or more material grain alterations in a structure that creates different microstructures in at least one section of the structure comprising elongation or stretching of polycrystalline or material grain in said structure that create a different material flow than other sections of the structure based on design parameters comprising a first force loading, a first force loading direction produced by said first force loading above a first predetermined force value, and a desired or predetermined direction of said material flow within said structure produced upon application of said first force loading at a first vector associated with said first force loading with respect to the structure;

providing a metallic plate to be formed into said structure with said microstructures; and forming said one or more material grain alterations in said at least one section of said metallic plate by pressing or rolling at least one portion of said metallic plate to produce the elongation or stretching of the metallic plate's material grains to produce elongated grains that are elongated into narrow bands aligned with the desired or predetermined direction of material flow of said structure produced in response to the first force loading and the first force loading vector.

4. The method of claim 3, wherein said forming one or more material grain alterations by elongating or stretching of the material grains comprises forming said metallic plate by cold rolling or working the metallic plate such that a longitudinal direction of rolling the plate is perpendicular to a long direction of the plate, thus a load on the plate would then be distributed over the longitudinal direction.

5. The method of claim 3, wherein said metallic plate is formed as a shaped charge liner, wherein manufacturing said structure with manufacturing-derived material grain alterations comprises an altered microstructure affecting the shaped charge's liner collapse and shaped charge jet formation from the liner as it collapses towards a focus point of the jet such that the microstructure comprises grains elongated into narrow bands aligned with the desired direction of material flow to orient the material flow towards the focus point.

* * * * *